US005142872A

United States Patent [19]

Tipton

[11] Patent Number: 5,142,872

[45] Date of Patent: Sep. 1, 1992

[54] LABORATORY FREEZER APPLIANCE

[75] Inventor: Russell C. Tipton, Williamstown, W. Va.

[73] Assignee: Forma Scientific, Inc., Cincinnati, Ohio

[21] Appl. No.: 728,771

[22] Filed: Jul. 8, 1991

Related U.S. Application Data

[63] Continuation of Ser. No. 514,768, Apr. 26, 1990, abandoned.

[51] Int. Cl.[5] ..... F25B 9/00

[52] U.S. Cl. ..... 62/6; 62/440

[58] Field of Search ..... 62/6, 440

[56] References Cited

U.S. PATENT DOCUMENTS

| | | | |
|---|---|---|---|
| 1,843,026 | 9/1932 | Hunt . | |
| 1,844,677 | 2/1932 | Peltier . | |
| 2,435,942 | 2/1948 | McMahon . | |
| 2,745,262 | 5/1956 | Kohler . | |
| 2,750,765 | 6/1956 | Kohler et al. . | |
| 3,504,505 | 4/1970 | Aske et al. . | |
| 3,552,120 | 1/1971 | Beale . | |
| 4,183,214 | 1/1980 | Beale et al. | 60/520 |
| 4,330,992 | 5/1982 | Senft | 60/518 |
| 4,330,993 | 5/1982 | Beale | 60/520 |
| 4,339,960 | 7/1982 | Senft | 74/50 |
| 4,366,676 | 1/1983 | Wheatley et al. | 62/6 |
| 4,372,128 | 2/1983 | Sarcia | 62/6 |
| 4,375,749 | 3/1983 | Ishizaki | 62/6 |
| 4,389,849 | 6/1983 | Gasser et al. | 62/6 |
| 4,404,802 | 9/1983 | Beale | 60/520 |
| 4,406,124 | 9/1983 | Chagnot | 60/520 |
| 4,412,418 | 11/1983 | Beale | 60/520 |
| 4,429,530 | 2/1984 | Beale | 60/520 |
| 4,458,495 | 7/1984 | Beale | 62/6 |
| 4,546,663 | 10/1985 | Wood | 74/40 |
| 4,583,364 | 4/1986 | Wood | 60/520 |
| 4,623,808 | 11/1986 | Beale et al. | 310/15 |
| 4,642,547 | 2/1987 | Redlich | 322/3 |
| 4,649,283 | 3/1987 | Berchowitz et al. | 290/1 R |

OTHER PUBLICATIONS

"Development of a mechanically refrigerated cryogenic preservation system using a mixed refrigerant technique to maintain specimen temperatures of −135° C.," by William B. White et al, Queue Systems (7 pages).

Queue Systems Brochure, "Trust the cold facts" (16 pages).

*Primary Examiner*—Ronald C. Capossela

*Attorney, Agent, or Firm*—Wood, Herron & Evans

[57] ABSTRACT

A laboratory freezer appliance providing a usable storage space on the order of 5 to 20 cubic feet capable of storage temperatures of −160° C. and lower including an insulated freezer chamber, heat transfer tubes in proximity to the freezer chamber carrying liquid argon at ultra-low temperatures which absorbs heat from the freezer chamber thereby vaporizing the argon in the heat transfer tubes; a closed cycle, hermetically-sealed free piston Stirling cycle heat pump providing a cold end above a vertical displacer driven by a linearly reciprocating piston at a delta T to the freezer chamber of about −13° C.; a condensing chamber surrounding the cold end of the heat pump for condensing argon vapor to the argon liquid; and a distributor for distributing liquid argon from the condensing chamber to the heat transfer tubes and returning argon vapor to the condensing chamber, all without mechanical pumping of the argon, in a continuous, closed cycle refrigeration system.

26 Claims, 9 Drawing Sheets

10

| POINT NO. | X-AXIS | Y-AXIS |
|---|---|---|
| 1 | 0.0 | 0.0 |
| 2 | 0.00674 | 0.01026 |
| 3 | 0.01705 | 0.01727 |
| 4 | 0.02856 | 0.02211 |
| 5 | 0.04062 | 0.02539 |
| 6 | 0.05292 | 0.02755 |
| 7 | 0.06535 | 0.02889 |
| 8 | 0.07783 | 0.02967 |
| 9 | 0.09032 | 0.03005 |
| 10 | 0.10282 | 0.03020 |
| 11 | 0.11532 | 0.03025 |

LABORATORY FREEZER APPLIANCE

This is a continuation of copending application Ser. No. 07/514,768 filed on Apr. 26, 1990 now abandoned.

BACKGROUND OF THE INVENTION

This invention relates to a cryogenic temperature storage chamber and, more particularly, to a laboratory freezer appliance that provides a freezer storage space, e.g., on the order of 5 to 20 cubic feet, capable of storage temperatures of −160° C. and lower.

In both research and diagnostic laboratory applications, low temperature refrigeration of living biological systems and biomaterials is required to produce satisfactory preservations. That is, the biochemical and physical processes by which biomaterials sustain life are affected to varying degrees by temperature. Thus, in applications where ultralow temperatures are successful in arresting these processes, lower storage temperatures are desired to achieve more satisfactory results, particularly for long term storage of biological specimens. The need therefore exists for a reliable laboratory freezer appliance which provides a usable freezer storage space at a consistent and uniform ultralow temperature, e.g., −160° C. and lower, for essentially unattended, extended storage periods.

There are two types of equipment which currently attempt to address, in part, this need. One is by stored refrigeration in the form of vacuum insulated liquid nitrogen dewars designed with a storage space in the vapor above the liquid nitrogen. There are a number of limitations to liquid nitrogen dewars. First, the only practical insulation is in the form of vacuum insulation. Due to strength requirements, the configuration of the storage chamber must necessarily be either cylindrical or spherical which is not an efficient use of space in traditional rectangular buildings and rooms. Second, nitrogen is a liquid at −196° C. at atmospheric pressure, which is an acceptable storage temperature. However, in liquid nitrogen dewars, the temperature may vary greatly, for example, up to 100° C. from top to bottom depending on the design of the vessel and the quality of the insulation, with a significant portion of the chamber maintaining temperatures much warmer than the desired −160° C. temperature. Thus, the physical placement of specimens within the vapor dictates their long term storage temperature, and uniformity and repeatability of storage conditions, particularly over long storage times, is as a practical matter impossible. Third, the source of cooling in a liquid nitrogen dewar is the phase change of the nitrogen from liquid to vapor. Thus, it is necessary for the dewar to regularly receive a fresh supply of liquid nitrogen to replace the boiled-off quantity. Although liquid nitrogen is not particularly expensive, availability and handling do cause problems, and liquid nitrogen cannot be stored indefinitely at ambient temperatures of typically 20° C.

The other type of equipment attempting to provide ultralow refrigeration temperatures is a mechanical system using a mixture of refrigerant components which are compressed by one or more refrigeration compressors. Such refrigeration systems can include a single standard commercial air-conditioning compressor which serves as a pump to move the refrigerant, which is a mixture of fluorocarbon refrigerants, through the system, an air- or water-cooled condenser which cools the compressor and removes heat from the refrigerant by partially changing the mixture from vapor to liquid, a liquid/vapor separator which separates liquid refrigerant from vapor and returns lubricating oil to the compressor, multiple heat exchangers to effect the cooling process, and an evaporator coil through which the refrigerant flows at ultralow temperatures to absorb heat from the freezer interior and deliver it to the condenser for removal. Again, there are a number of problems with this refrigeration system. First, these systems currently operate at temperatures of −135° C. to −150° C. which fall short of the desired temperature of −160° C. Second, the development of the refrigeration circuit for this product is highly intuitive because the properties of the mixed refrigerants are difficult to predict with any accuracy as are the heat transfer and flow characteristics of the mixtures. Third, the mixed refrigerants are fluorocarbon refrigerants which may have to be replaced in the future for environmental reasons.

BRIEF DESCRIPTION OF THE INVENTION

It is among the principal objectives of this invention to provide a laboratory freezer appliance capable of providing consistent and repeatable storage conditions at temperatures of −160° C. and lower for extended and unattended storage periods. The freezer has a usable storage space of, e.g., 5 to 20 cubic feet. In accordance with the principal objectives of this invention and inherent in the term "appliance," the freezer operates on normally available 220 volt AC 50/60 Hz single phase electricity; the installation and start up consists of little more than unpacking and leveling the unit, plugging it into the power source, turning the unit on and waiting for cool down from room temperature to operating temperature, e.g., −160° C., which takes only about one-half day; the unit will operate continuously with only occasional unskilled maintenance for the first five years of continuous operation; the unit is configured to use space efficiently; and the aesthetic appearance of the freezer is pleasing and the noise and vibration levels are relatively low. Thus, the unit looks and sounds substantially like a typical household freezer.

In its general aspects, the cryogenic freezer appliance of the present invention includes an insulated freezer chamber; heat transfer tubes in proximity to the freezer chamber carrying a refrigerant at ultralow temperatures which absorbs heat from the freezer chamber thereby cooling the storage chamber and vaporizing the refrigerant in the heat transfer tubes; a condensing chamber surrounding the cold end of a closed cycle, hermetically sealed, free piston, Stirling cycle heat pump, which includes a linearly reciprocating piston and a displacer in the cold end of the heat pump removed from the piston and driven in reciprocation by the alternate expansion and compression of a working gas within a working space above the piston, for condensing the vaporized refrigerant to a liquid; a distributor for distributing the liquid refrigerant back to the heat transfer tubes; and a rejector for removing heat from the heat pump in a continuous, closed cycle refrigeration system.

In a presently preferred form of the invention, a heat transfer fluid such as argon enters a condensing chamber surrounding the cold end of a Stirling cycle heat pump in the form of argon gas. The argon gas is condensed therein to a liquid at an ultralow temperature and flows by gravity to an argon distributor having a centrally located liquid argon reservoir and a number of tubes extending around the periphery of the reservoir which substantially evenly deliver the liquid argon refrigerant to heat transfer tubes which extend along either side of the freezer storage chamber in heat transfer communication therewith. The heat transfer tubes slope downwardly from the argon distributor such that the liquid argon flows along the tubes by gravity. The heat transfer tubes are externally finned to provide a large heat transfer surface. The liquid argon in the heat transfer tubes absorbs heat from the interior of the freezer storage chamber causing convective flow of ultralow temperature air through the storage chamber in turn lowering of the chamber temperature to desired operating temperature which may be on the order of −160° C. or below. The liquid argon is vaporized by the absorbed heat, and the vapor returns to a head space above the reservoir of the argon distributor in the same heat transfer tubes that carry the liquid argon from the distributor. The argon gas then flows from the argon distributor to the condensing chamber surrounding the cold end of the Stirling cycle heat pump where the argon is again condensed to a liquid and returned to the argon distributor in a continuously operating closed cycle refrigeration process. The operating pressure of the system is on the order of 5 bar. No external pumping means is provided to move the refrigerant through the system thereby eliminating any moving parts and the need for any lubricants which would freeze up at the ultralow temperatures involved in the cryogenic freezer.

The Stirling cycle heat pump includes a compressor having an electrically linearly driven reciprocating piston and a displacer removed from the compressor driven in reciprocation by the alternate expansion and compression of a working gas, preferably helium, in the working volume above the piston. The piston of the compressor is driven by a linear electric motor at a frequency of 44 Hz to provide a generally sinusoidal pressure variation in the helium gas. The compressing movement of the piston causes pressure of the helium gas to rise from a minimum pressure of about 285 psig to a maximum pressure of about 375 psig. The pressure rise of the helium gas causes the displacer in the cold end of the heat pump, which is free to move in the cold end, at a point in the cycle to move rapidly downward. With the downward movement of the displacer, high pressure working gas at about ambient temperature is forced through a regenerator and into the cold space above the displacer. The regenerator absorbs heat from the flowing pressurized gas and thus reduces the temperature of the gas. As the compressor piston reverses direction in the sinusoidal drive pattern provided by the linear drive motor and begins to expand the volume of gas in the working space above the piston, the high pressure helium above the displacer is cooled even further. This cooling in the cold space provides refrigeration for maintaining an average temperature gradient of over 200° Kelvin over the length of the regenerator and an input of about 200 watts of heat from the argon to the expansion space helium at the low temperatures of −160° C. or less. At a point in the expanding movement of the piston, the pressure in the working volume of helium gas drops sufficiently so that the momentum of the displacer is overcome by a retarding force on the displacer provided by an internal gas spring which is stabilized at a pressure between the minimum and maximum pressures of the helium gas. The displacer is then driven to its starting position. The displacer thus cycles with the piston but out of phase therewith.

The argon gas refrigerant to be cooled circulates in the condensing chamber which is in the form of a pressure vessel external of but surrounding a cold end cup of the heat pump. The cold end cup is formed of a highly heat conductive material that does not become brittle at temperatures of −160° C. or lower, such as a stainless steel, and the outer surface of the cold end cup is provided with a heat conductive sleeve having a series of fins having an Adamak fin profile to increase heat transfer to the argon gas in the condensing chamber.

A temperature differential of about 13° C. is maintained between the desired storage chamber temperature and the helium in the cold end of the heat pump and about 10° C. between the storage chamber temperature and the temperature of the liquid argon. Thus, for a −160° C. storage chamber temperature, the liquid argon is at −170° C. and the helium is at −173° C. The 200 watts of heat input into the helium in condensing the argon gas in the pressure vessel surrounding the cold end cup plus the input work to drive the heat pump compression and expansion cycles are rejected to the environment external of the heat pump by a heat rejector/condenser assembly.

As stated, the cryogenic freezer provides a suitable storage space, e.g., from 5 to 20 cubic feet, capable of providing a consistent and uniform freezer temperature of −160° C. or lower. There are no external pumping means to pump the refrigerant through the distribution chamber and heat transfer tubes. Further, there is no traditional petroleum-based lubrication in the system which otherwise would be subject to freezing by virtue of the ultralow temperatures of the system and to contamination of the refrigerant and the working gas in the heat pump. Rather, the moving parts of the heat pump are spun during operation to provide hydrodynamic non-contact gas bearings which, since no contact between rotating and stationary parts is allowed, eliminates the need for traditional lubricants.

DETAILED DESCRIPTION OF THE INVENTION

Freezer Cabinet

Figure 1:
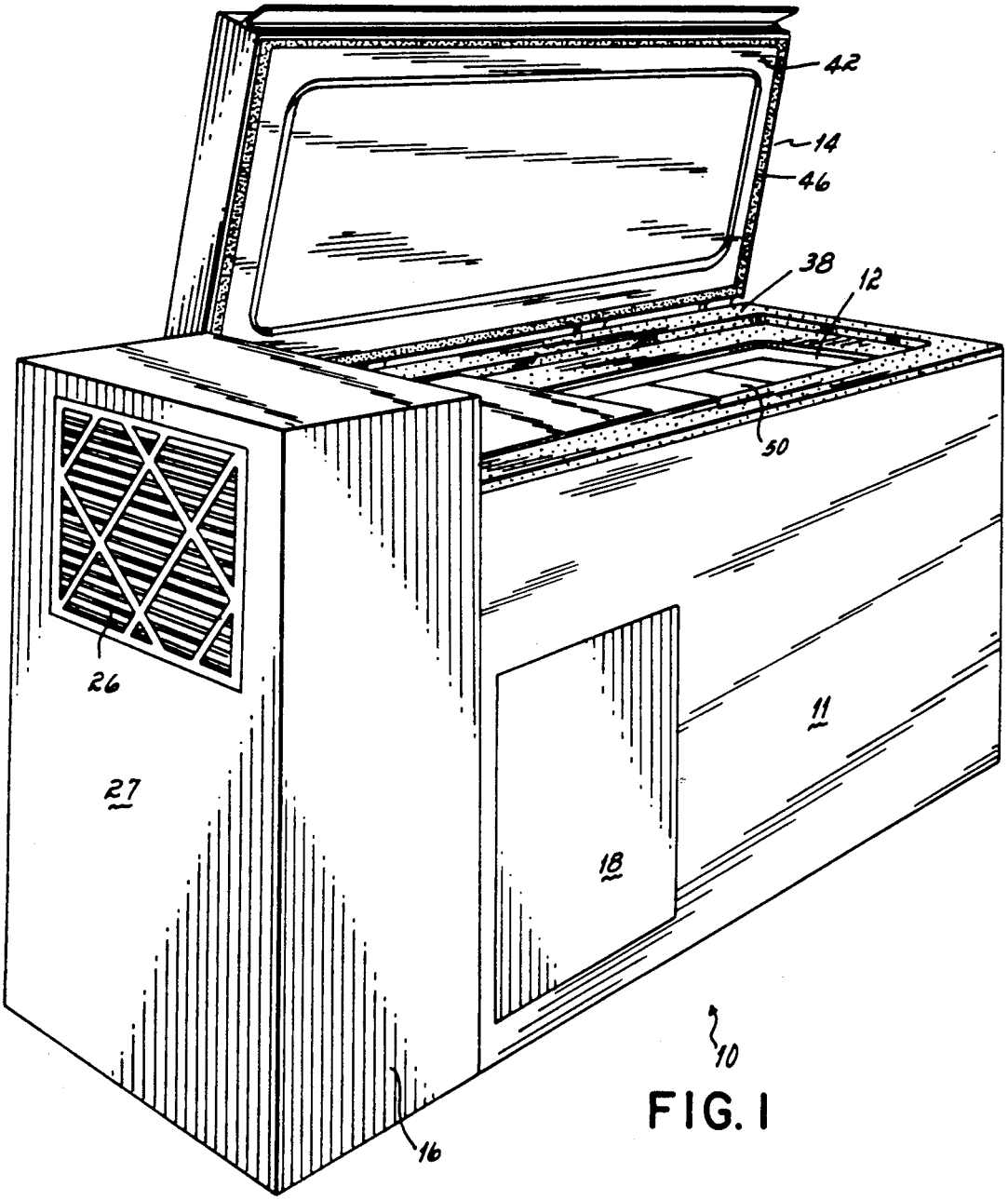
FIG. 1 is an isometric view of the cryogenic freezer of the present invention.

Referring now to FIG. 1, in its general aspect, the cryogenic freezer 10 includes a cabinet 11 which houses a freezer storage chamber 12 interiorly of the cabinet 11, a lid 14 to seal closed the freezer storage chamber 12 and to provide access thereto, and a side car cabinet 16. An access panel 18 provides access to the Stirling cycle heat pump 20 (FIG. 2), which will be described in detail below. A condenser 22 and blower 24 are housed in the side car cabinet 16. The blower 24 draws air through a grill 26 (FIG. 1) in an end wall 27 of the cabinet 16 and over the condenser 22 to condense a refrigerant for removing heat from the heat pump 20, as also will be described in detail below.

The freezer 10 is generally rectangular in configuration making it suitable for efficient use in a laboratory. The cabinet 11, lid 14, and side car 16 are formed of 18-gauge cold-rolled steel which is painted for protection and aesthetics. Typical physical dimensions of the freezer 10 are an overall external dimension of 91" long by 46.5" high by 28.5" front to back. Typical interior chamber dimensions are 43.5" long by 32" high by 16¼" deep, which provides two 42.5" long by 27" high by 6¼" deep usable storage volumes, or about 8 cubic feet of usable storage volume. Caster wheels 28 are provided to permit convenient movement of the freezer 10 in the laboratory or other facility. The freezer operates on normally available 220 volt (180 to 250 VAC 50/60 Hz single phase) electricity; and its installation and start up consists of essentially unpacking and leveling the unit, plugging the unit into the power source, turning on a switch and waiting for the unit to cool down to its operational temperature of −160° C., which takes approximately one-half day. The freezer is designed to operate continuously with only occasional unskilled maintenance for its first five years.

Figure 2:
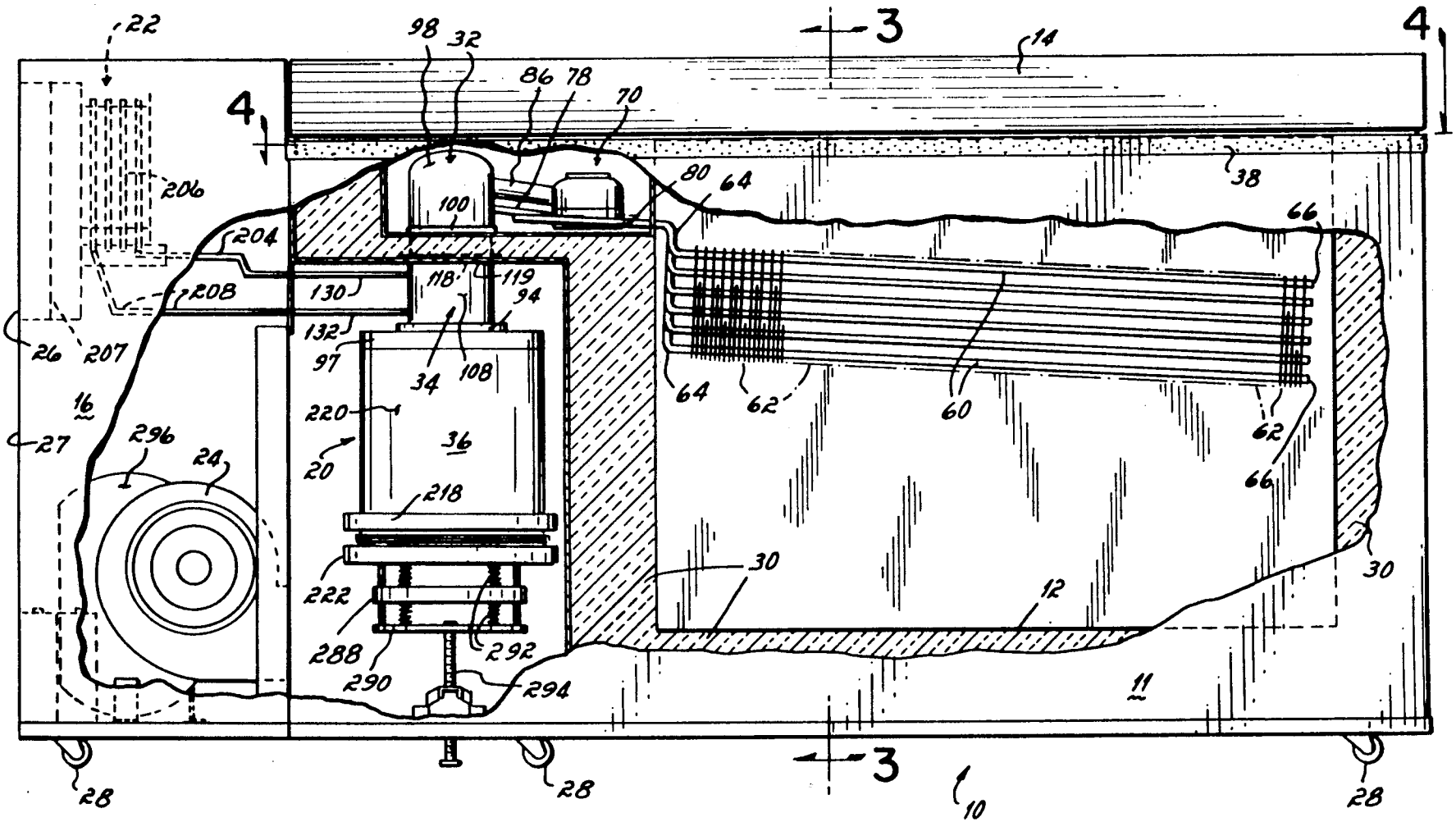
FIG. 2 is a front view of the cryogenic freezer shown in FIG. 1 with walls broken away to show internal components.
Figure 3:
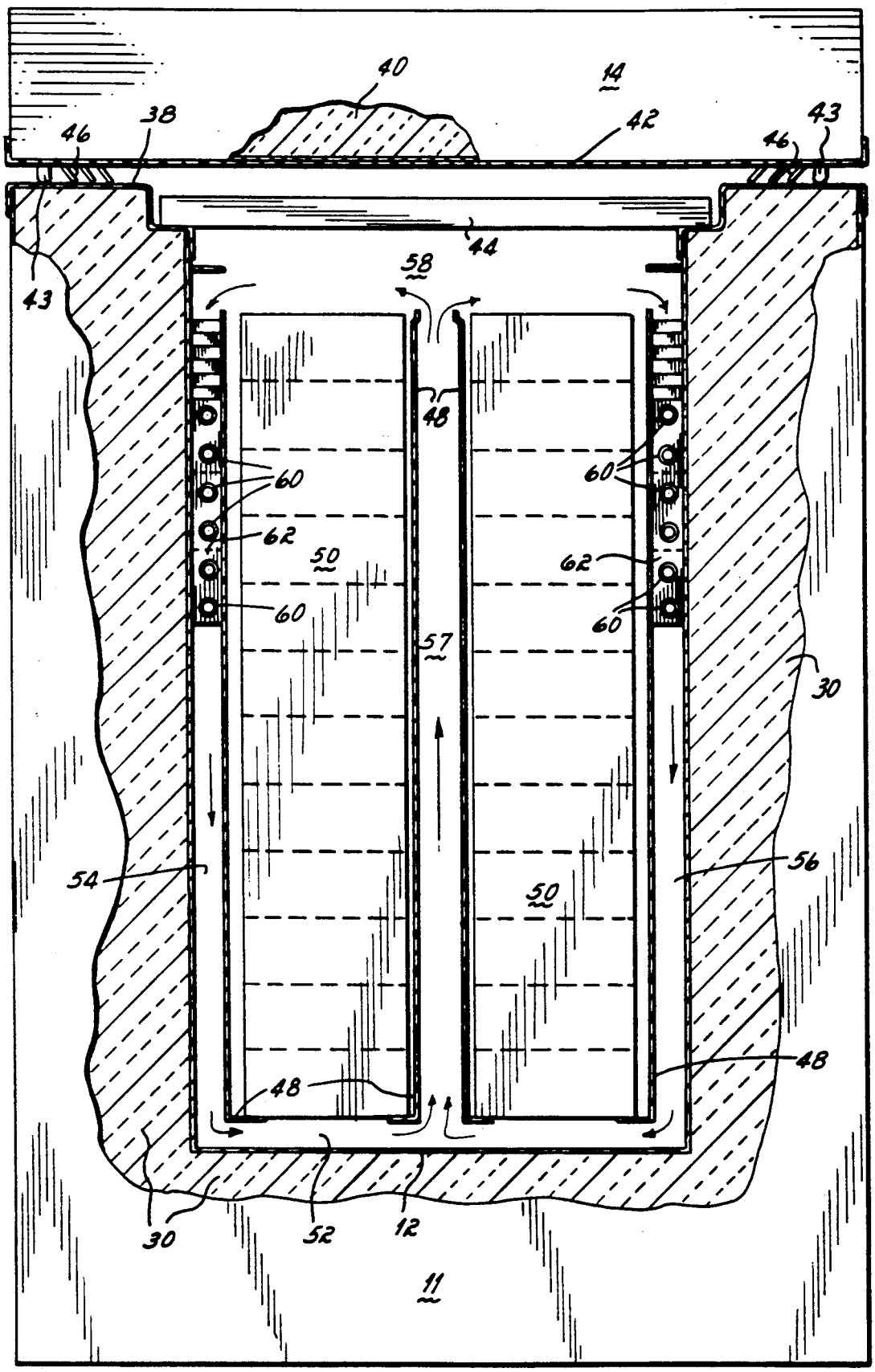
FIG. 3 is a view taken along 3—3 of FIG. 2.

Referring now specifically to FIGS. 2 and 3, the freezer storage chamber 12 is formed of 20-gauge type 304 stainless steel for good thermal conductivity and corrosion protection. The storage chamber 12 is surrounded by an insulative material 30 such as a foamed-in-place urethane having a density on the order of 3 pounds per cubic feet. That is, the outer shell 11 and freezer storage chamber 12 are placed in a fixture which holds the inner and outer walls in place. Thereafter, the urethane is added as a liquid with a foaming agent and foamed in place against the facing walls of the shell 11 and storage chamber 12. The insulation is generally 6" thick at the side walls and 7" thick at the bottom between the bottom of the storage chamber 12 and the outer shell 11. As shown in FIG. 2, the insulation 30 surrounds the bottom, side, and end walls of storage chamber 12 and extends around the Stirling cycle heat pump 20 to isolate the the freezer storage chamber 12 and the cold end (shown generally at 32) of the heat pump 20 from the warm heat rejector 34 and compressor assembly 36 of the heat pump 20.

As shown best in FIG. 3, a hard, low thermal conductivity plastic panel 38, such as a vinyl ester resin/fiberglass mat reinforced plastic, extends around the top between the freezer chamber 12 and the outer wall of the cabinet 11 and is adhesively joined to the steel cabinet and freezer chamber walls. The freezer lid 14 likewise has a foamed-in-place urethane insulative core 40, conveniently 5" thick, and a plastic mat lid liner 42 joined to the lid 14. A snap-in plastic extrusion (not shown) joins the lid 14 and lid liner 42 for foaming of the insulative core 40 in place. This extrusion also retains a bulb gasket 43 in the lid 14 surrounding chamber 12. These fiberglass mat reinforced panels 38, 42 have decreased thermal expansion while maintaining flexibility. A plastic foam sublid 44 rests above the top of the freezer chamber 12. The lid liner 42 is formed to receive a second gasket 46, which may conveniently be a combination of several feather gaskets, adhered in a groove in the plastic lid liner 42.

Figure 4:
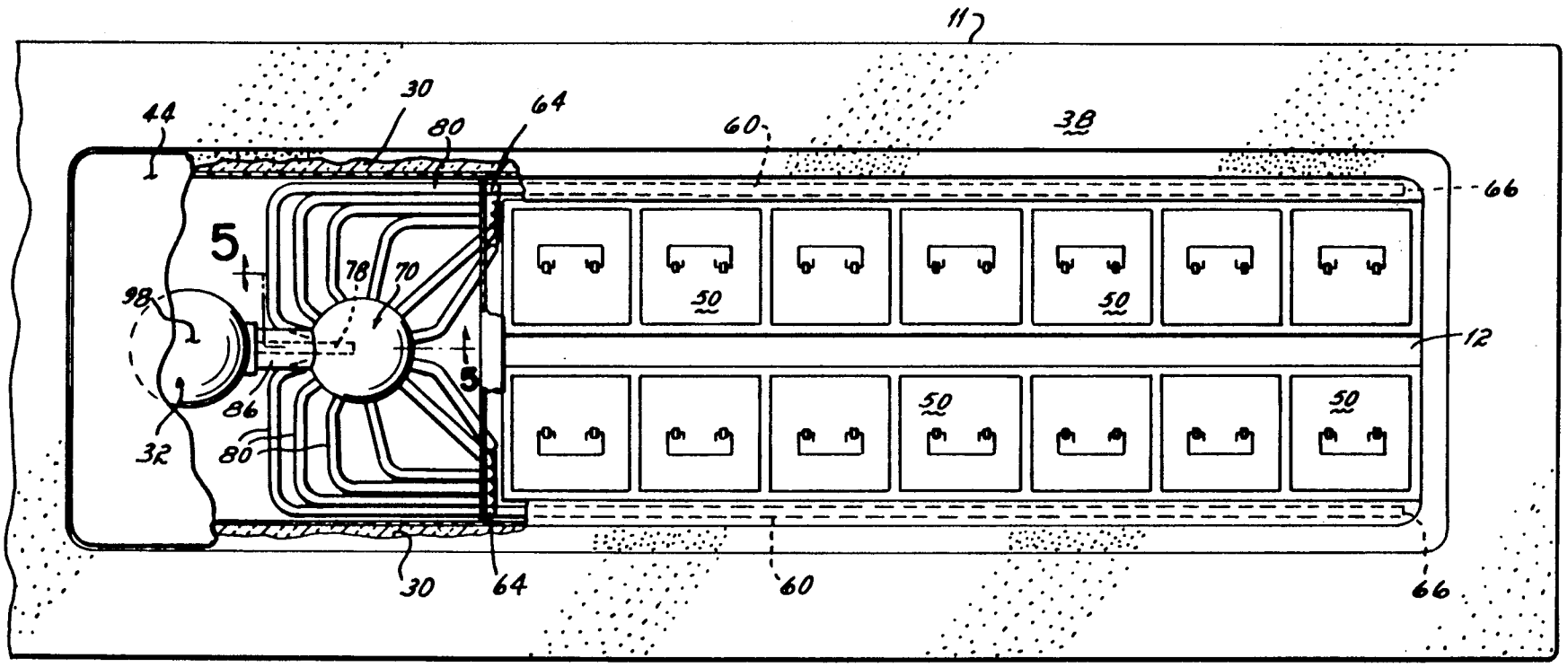
FIG. 4 is a view taken along 4—4 of FIG. 2.

A stainless steel, e.g., type 304, rack 48 is supported interiorly of the freezer storage chamber 12 which in turn supports standard storage boxes or items 50 contained in the freezer chamber 12. The rack 48 is spaced inwardly from the side and bottom walls of the chamber 12 and below the sublid 44, and the storage boxes 50 are in rows spaced from each other down the center of the chamber 12 (FIGS. 3 and 4). This results in an open space 52 at the bottom of the chamber 12, spaces 54, 56 along the sides, a space 57 between the rows of storage boxes 50, and a space 58 above the storage boxes 50 and below the sublid 44. These spaces are important to permit circulation by convection of ultralow temperature air in the freezer storage chamber 12, as described below.

Heat Transfer System

A series of heat transfer tubes 60 extend along the length of the storage chamber 12 in the spaces 54, 56 between the inner wall of the chamber 12 and the support racks 48. The tubes 60 are formed of copper for its heat transfer properties and its corrosion resistance, and the tubes are typically 0.5" in outside diameter with a 0.022" wall. Six vertically spaced tubes 60 are provided along the front of the chamber 12 and six along the rear of the chamber 12 for a total of twelve heat transfer tubes. The tubes 60 are spaced about 1¼ inches apart. The tubes 60 include external flat copper fins 62 0.008" thick to increase the heat transfer to the surrounding air. Four fins per inch are provided on the upper two tubes, six fins per inch are provided on the middle two tubes, and eight fins per inch are provided on the lower two tubes.

The copper heat transfer tubes 60 circulate a heat transfer fluid along the length of the storage chamber. A presently preferred heat transfer fluid is argon as a saturated liquid at −170° C. when a storage chamber temperature of −160° C. is desired. Other heat transfer fluids such as oxygen, nitrogen, and natural gas could be used. Oxygen and natural gas, however, have the disadvantage of being flammable, and nitrogen has a higher saturation pressure. Argon, on the other hand, is non-flammable and non-explosive at room temperature and atmospheric pressure, and argon has a saturation pressure of less than 50 psig at −170° C. The liquid argon at ultralow temperatures flows down the heat transfer tubes 60 along the length of the storage chamber 12 by the force of gravity due to the tubes 60 being sloped downwardly from their inlet end 64 to their opposite end 66. Gravity flow of the argon refrigerant eliminates the need for a pump which would have moving parts which would require lubrication.

The liquid argon in the heat transfer tubes 60 absorbs heat from the storage chamber 12 cooling the surrounding air and causing the argon to vaporize in the tubes 60. The argon gas in the tubes 60 forms a gas head above the liquid in the heat transfer tubes 60 and is transported back to the inlet end 64 of the tubes 60 in a counterflowing direction to the flow of the liquid argon.

Placement of the heat transfer tubes 60 at the top of the storage chamber 12, as shown in FIGS. 2 and 3, causes a natural convective flow of ultralow temperature air in the chamber 12 (in the direction shown by the arrows in FIG. 3) surrounding the storage boxes 50. That is, the ultralow temperature air circulates downwardly along the side walls in spaces 54, 56, across the bottom space 52, and upwardly in the space 57 between the storage boxes 50, and across the space 58 at the top of the chamber 12 below the sublid 44 and back to the heat transfer tubes 60.

Figure 5:
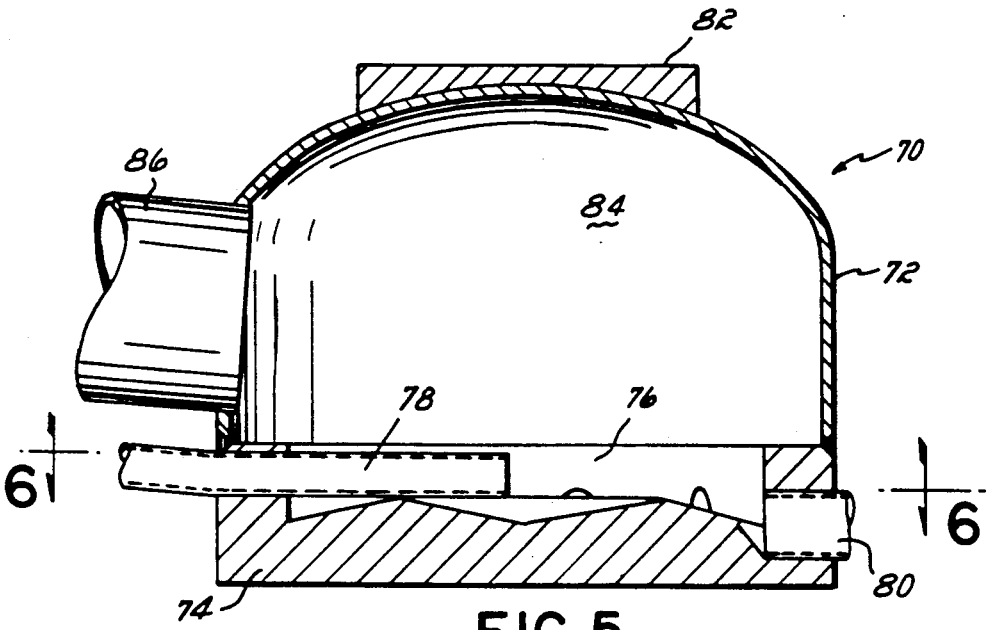
FIG. 5 is a view taken along 5—5 of FIG. 4.
Figure 6:
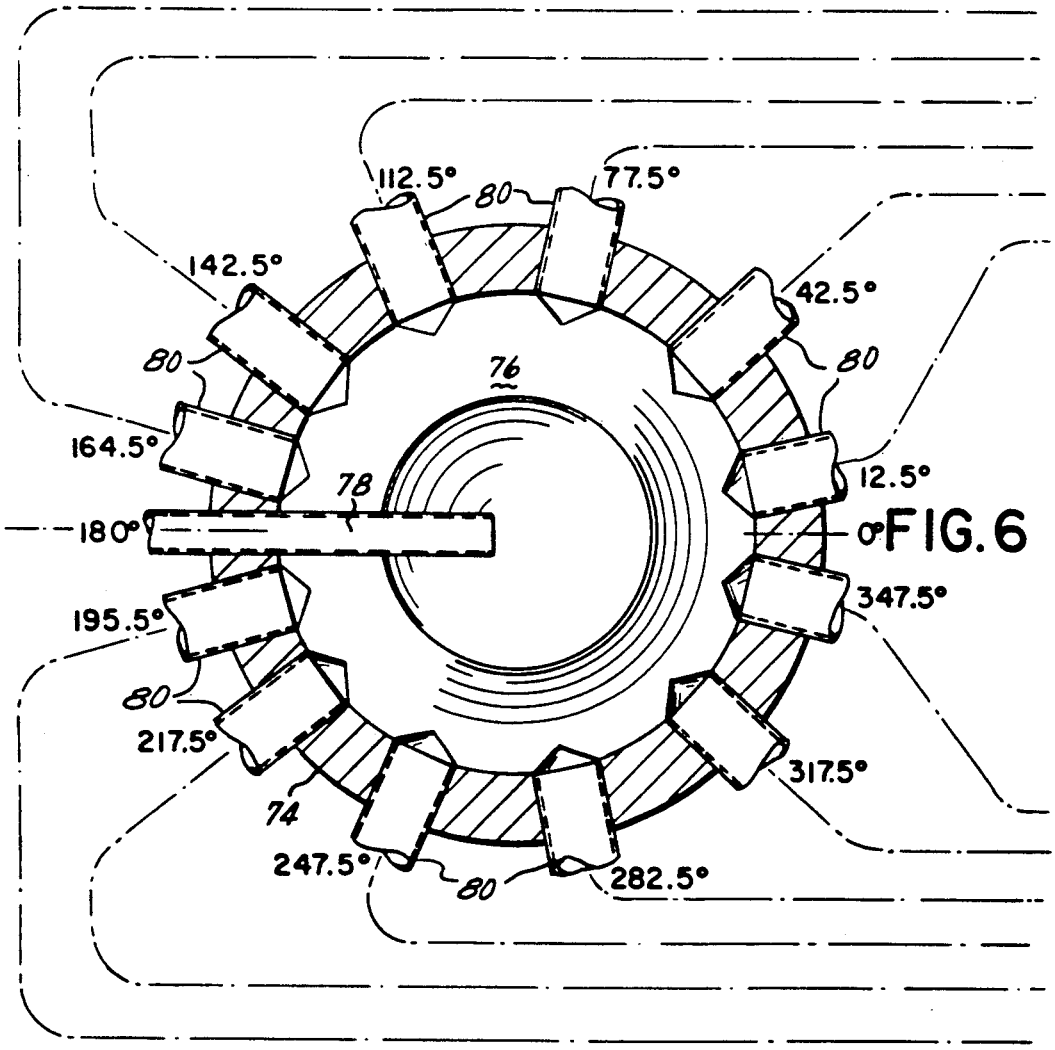
FIG. 6 is a view taken along 6—6 of FIG. 5.

An argon distributor 70, whose location is shown generally in FIGS. 2 and 4 and whose details are shown in FIGS. 5 and 6, is located at the top of the freezer 10 outside of the storage chamber 12 between the cold end 32 of the heat pump 20 and the inlet end 64 of the heat transfer tubes 60. The argon distributor 70 consists of a domed chamber 72 formed of type 304 stainless steel, which is welded at its base to a reservoir 74, also formed of type 304 stainless steel, having a circular basin 76 therein which is fed with liquid argon through a tube 78 communicating at its other end with the cold end 32 of the Stirling cycle heat pump 20. Twelve liquid argon distribution tubes 80 communicate with the liquid argon reservoir 74 about its circumference. That is, the liquid argon distribution tubes 80 open into the bottom of the basin 76 and are spaced about its circumference to achieve a substantially uniform distribution of the liquid argon which flows into and fills the basin 76 to each of the tubes 80. The distribution tubes 80 are joined at their opposite ends to the inlets ends 64 of the twelve heat transfer tubes 60. The argon distributor 70 is conveniently formed with a 3.5" diameter basin 76, a 0.375" diameter feed tube 78, and twelve 0.5" distribution tubes 80. A leveling surface 82 aids in leveling of the reservoir 74 to aid in achieving uniform distribution of liquid argon to each of the tubes 80. In a presently preferred form of the invention, the tubes 80 are spaced about the circumference of the reservoir 74 from a 0° reference line shown in FIG. 6 at the angles indicated for each of the twelve tubes 80. This is done to match the liquid argon flow to the heat capacity of the individual tubes 60.

Argon gas is returned to the argon distributor 70 by flowing through the heat transfer tubes 60, the argon distribution tubes 80, and into a gas head space 84 above the liquid reservoir 74. A second tube 86, e.g., 1" in diameter, connects the head space 84 to a condensing chamber 90 (FIG. 7) at the cold end 32 of the Stirling cycle heat pump 20 where the argon gas is condensed to a liquid, and flows back through feed tube 78 to the reservoir 74 of the argon distributor 70, whereby a continuous cycle of argon condensation, distribution, vaporization, and condensation occurs. That is, the argon gas from the head space 84 in the argon distributor 70 flows through tube 86 to the condensing chamber 90 at the cold end 32 of the heat pump 20 where it is condensed to a liquid at −170°C. or lower. The liquid argon flows back through tube 78, which is slanted downwardly from the condenser 90 toward the distributor 70, into the reservoir 74 of the distributor 70, into the argon basin 76, and then out through the distribution tubes 80 by the force of gravity and into and along the heat transfer tubes 60 along the length of the freezer storage chamber 12. The liquid argon in the tubes 60 absorbs heat in the storage chamber 12 causing the liquid argon to vaporize with the argon gas then returning to the head space 84 in the argon distributor 70 above the liquid reservoir 74 in a counterflowing relation to the liquid argon and n a continuous sequence of argon gas condensation and vaporization.

Stirling Cycle Heat Pump

Figure 7:
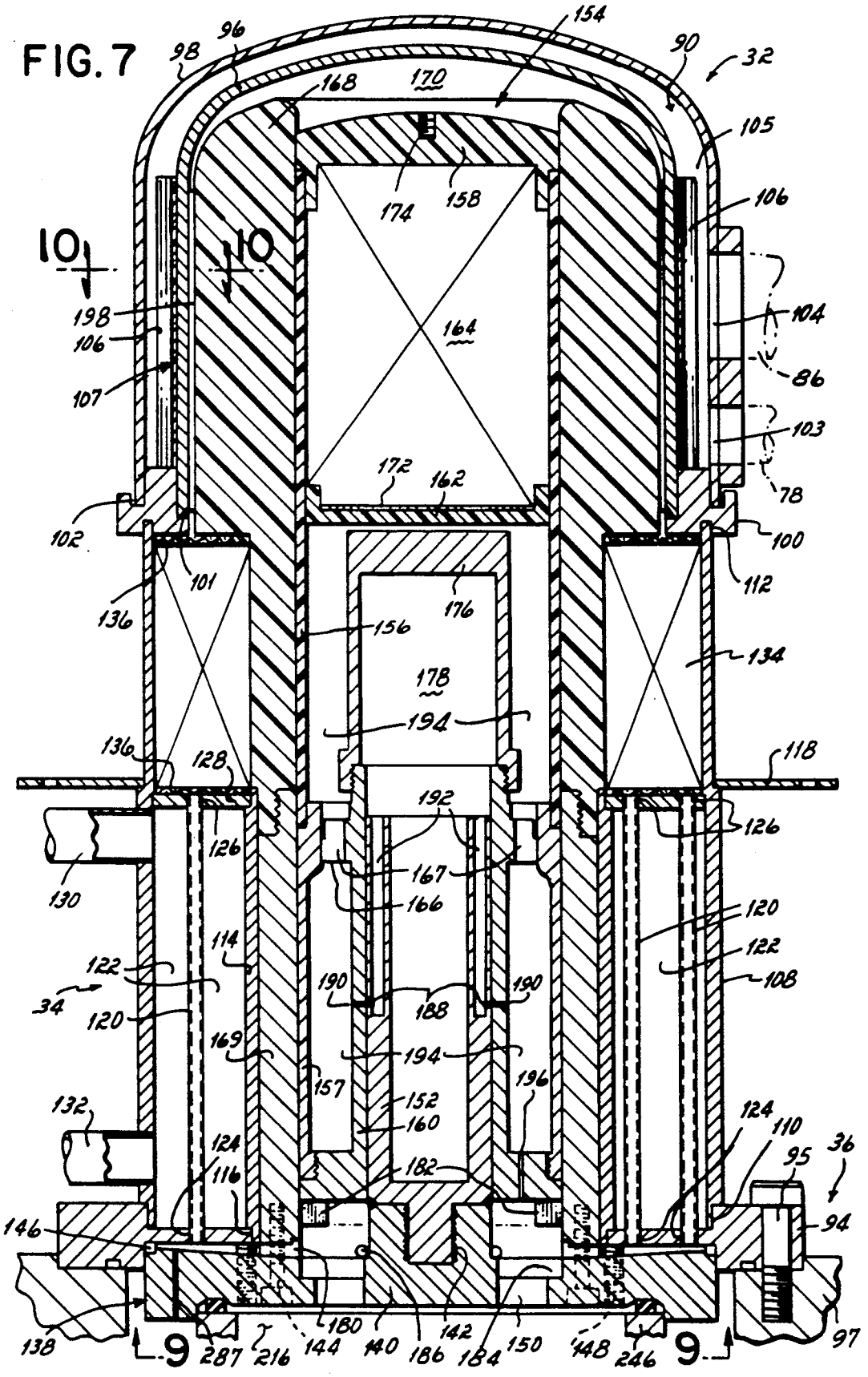
FIG. 7 is a cross-sectional view of the cold end heat exchanger, displacer, and rejector assembly of the Stirling cycle heat pump.
Figure 8:
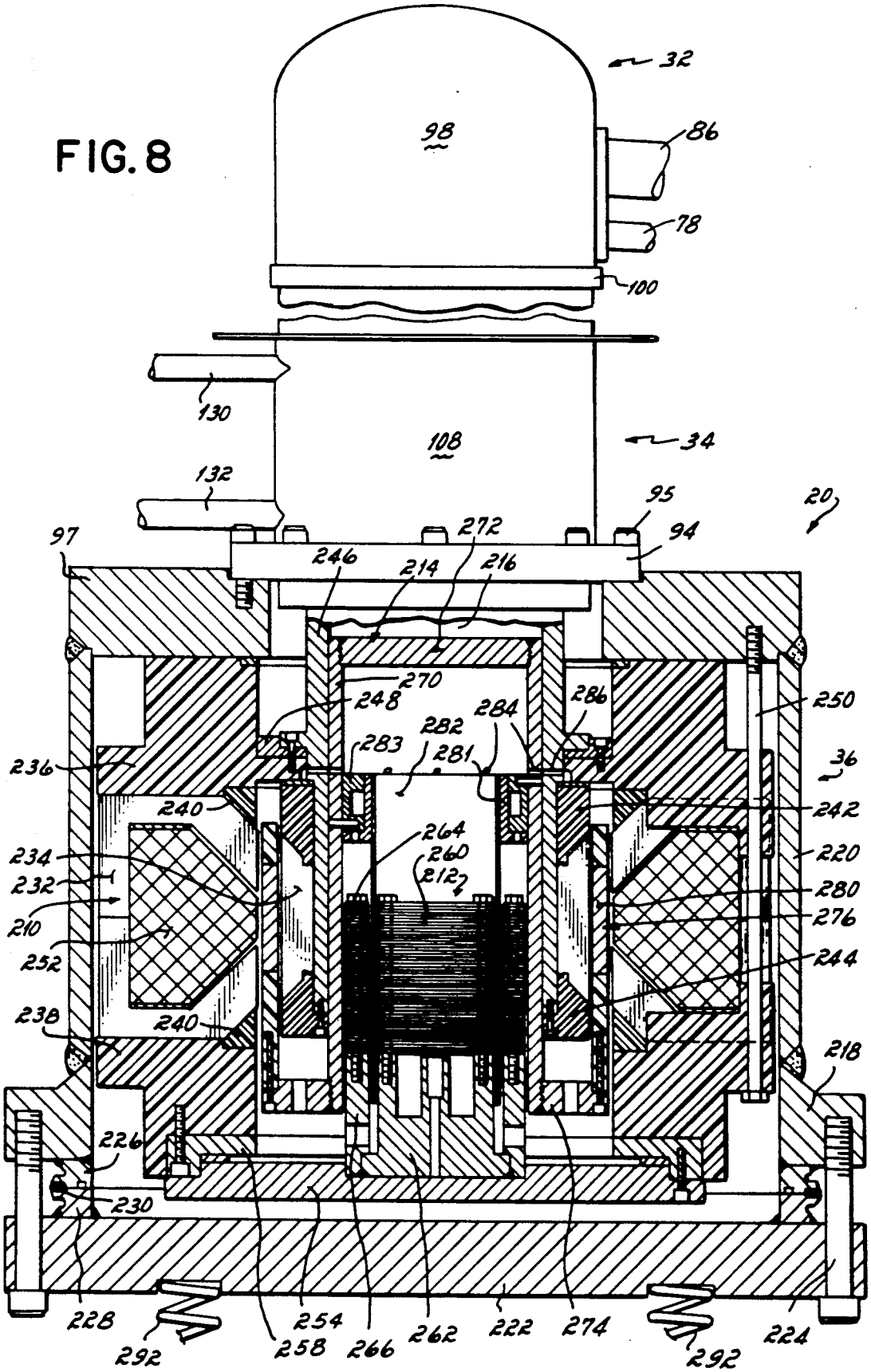
FIG. 8 is a side elevation view showing in cross-section the Stirling cycle heat pump compressor assembly.

The source of refrigeration is the closed cycle, hermetically sealed, free-piston Stirling cycle heat pump 20, which is shown in detail in FIGS. 7 and 8. The heat pump 20 is vertically disposed and includes the cold end 32 and associated condensing chamber 90 at the top, a heat rejector subassembly 34 therebelow, and the compressor assembly 36 below it. As shown most clearly in FIG. 8, the cold end 32 and heat rejector subassembly 34 are supported on a main support plate 94, which in turn is bolted by means of bolts 95 to a main support plate 97 of the compressor subassembly 36.

Cold End

The cold end 32 of the heat pump 20 includes a cold end cup 96 made of 12-gauge stainless steel conforming to ASTM-A-240 grade 304 and having a minimum wall thickness of 0.089 inch. The cold end cup 96 is surrounded by a similar 13-gauge stainless steel cap 98 of minimum wall thickness of 0.078 inch to form the argon condensing chamber 90 therebetween. The cap 98 and cold end cup 96 are formed in the shape of domes to accommodate the argon gas pressure which is on the order of five bars. The cold end cup 96 and condenser chamber cap 98 are joined to an annular stainless steel (type 304 or 304L) flange 100 with the cold end cup 96 being welded to the cold end flange 100 at 101 and the chamber cap 98 being welded at annular groove 102 to the flange 100. (The flange is shown diagrammatically in FIG. 7. In practice, the flange is formed of two concentric rings which engage to permit assembly and disassembly for testing. The cold end cup 96 and chamber cap 98 are welded to the inner ring. Upon completion of successful testing an annular seal weld seals the joint between the two rings to seal the cold end to prevent escape of helium.)

The liquid argon feed tube 78 and argon vapor tube 86 are welded to the wall of the chamber cap 98 and communicate with openings 103 and 104, respectively, in the wall of the cap 98 permitting flow of argon vapor through opening 104 into the space 105 between the cup 96 and cap 98 where the vapor is condensed to a liquid which then flows out by gravity through opening 103 and into the liquid argon supply tube 78 for return to the distributor 70.

Figure 10:
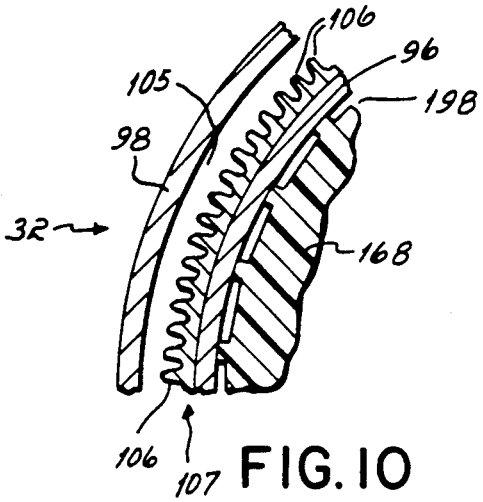
FIG. 10 is a view taken along lines 10—10 of FIG. 7.
Figure 11:
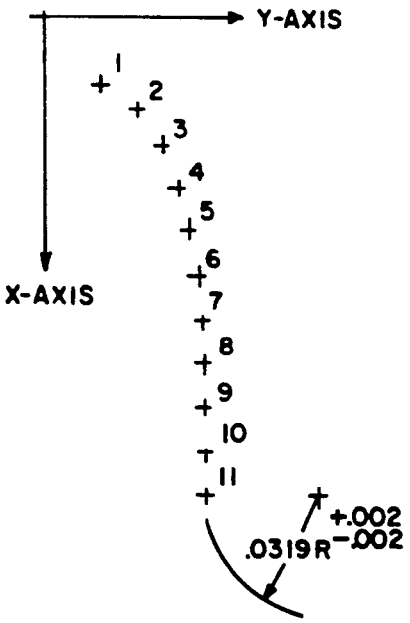
FIG. 11 is a diagram of a presently preferred profile of the Adamak fins of the cold end cup.

In a presently preferred form of the invention, the cold end cup 96 has an inner diameter of 4.550 inches and a minimum wall thickness of 0.089 inch. Referring in addition to FIG. 10, the cold end cup 96 is provided with an aluminum sleeve 107 having on its outer surface a plurality of contoured fins 106 to increase the heat transfer from the wall of the cold end cup 96 to the argon gas in the space 105. The sleeve 107 has an inner diameter 4.76 inch and outer diameter to the tip of the fins 106 of 5.144 inch. The sleeve 107 including fins 106 is 2.750 inch in length, and the fins 106 have a fin profile made according to the equations set out in the paper by Adamak, T., "Bestimmung der Kondensationgrossen auf feingewellten Oberflachen zur Auslegung optimaler Wandprofile," Warme-und-Stoffunbertragunh, vol. 15, 1981, pp. 255–270. An example of a suitable fin cutter profile is given in FIG. 11. There are 122 fins on the outer surface of sleeve 107 spaced on 2.937° intervals equaling a total of 358.3°. (One pair of fins is spaced 1.700). The sleeve 107 and fins 106 are formed of aluminum to maximize heat transfer. At room temperature, the diameter of the sleeve 107 is such that it fits loosely over the O.D. of the cup 96. As the temperature of the cold end 32 lowers, the aluminum sleeve 107 by virtue of its relatively higher coefficient of thermal expansion shrinks about the cup 96 to form in effect a shrink fit between the two parts. The intimate metal-to-metal contact further aids in maximizing heat transfer to the argon gas.

Heat Rejector

The heat rejector assembly 34 includes an outer cylinder 108 mounted at its base 110 in the main support plate 94 and at its top in a groove 112 in the cold end flange 100, and an inner cylinder 114 mounted at its base 116 to the support plate 94. (Again flange 100 is shown diagrammatically. In practice, the cylinder 10 is welded to the outer ring which in turn is seal welded to the inner ring.) The outer 108 and inner 114 cylinders are formed of Schedule 40 type 304L seamless stainless steel pipe. The heat rejector assembly 34 further includes a type 304L stainless steel upper flange 118 which is joined to the insulation support plate or pan 119 (FIG. 2). There are 180 type 304L stainless steel tubes 120 of 0.125" outside diameter by 0.020" thick wall by 4.240" long mounted in the space 122 between the inner 114 and outer 108 rejector cylinders. The tubes 120 are mounted at their bases in openings 124 in the support plate 94 and at their tops in openings 126 in an upper rejector tube support sheet 128 also formed of type 304L stainless steel. The tubes 120 are brazed in place as is tube support sheet 128. The tubes 120 are circumferentially spaced about the unit in three concentric rings.

Upper and lower rejector assembly stubs 130 and 132, respectively, extend through and are welded in the wall of the outer cylinder 108 of the rejector assembly 34 and communicate with the space 122 surrounding the rejector tubes 120. As will be described below, a refrigerant is circulated in the space 122 to remove heat from the gas passing through the tubes 120. The stubs 130, 132 are ½" in outside diameter × 0.035" in wall thickness × 1.5" in length and are formed of type 304 stainless steel. Four circumferentially spaced stubs 130 are provided at the top and two stubs 132 at the bottom.

The tubes 120 open at their top ends into a regenerator 134 located between the rejector assembly 34 and the cold end cap flange 100. The regenerator 134 is of standard construction and is a matrix formed of 22 micron diameter stainless steel wire having 80% porosity. Filters 136 are located at the top and bottom of the regenerator 134 to prevent particles of the stainless steel wire from becoming dislodged and being caught in the gas flowing through the regenerator. The filters 136 are preferably formed of a spunbonded sheet of continuous polyester fibers that are randomly arranged, highly dispersed, and bonded at the filament junctions. The filtration efficiency is greater than 90% for particles larger than 5 microns and the pressure drop for air flow is 0.5 inches of water gauge at 180 ft/min velocity. A suitable material is Reemay 2295 sold by Snow Filtration Co. of Cincinnati, Ohio.

Displacer Assembly

Figure 9:
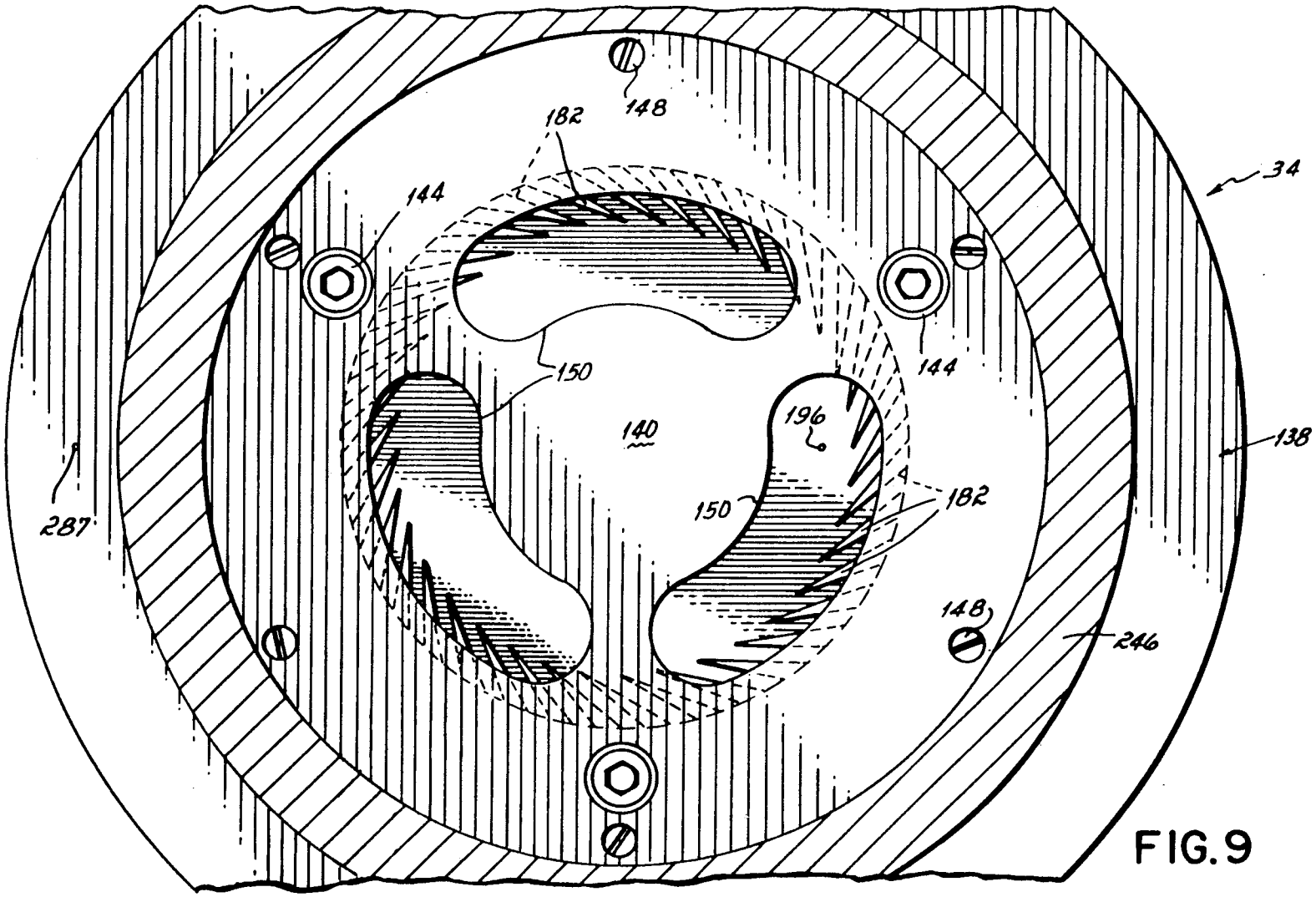
FIG. 9 is a view taken along 9—9 of FIG. 7.

A displacer support plate 138 which includes a central hub 140 having a internally threaded recess 142 is bolted to the assembly by means of bolts 144 passing upwardly therethrough. A gasket 146 seals the periphery between the displacer support plate 138 and main support plate 94. Set screws 148 are provided in the displacer support plate 138, as hereinafter described. As best seen in FIG. 9, the displacer support plate 138 has three openings 150 surrounding the hub 140 permitting passage of the helium working gas between the compressor 36 and cold end assembly 32.

A displacer support rod 152 is screwed into the recess 142 and then welded to the central hub 140.

A displacer assembly 154 includes a cylindrical displacer tube 156, a cylindrical displacer sleeve 157, a shell cap 158, a displacer rod guide 160, which surrounds the displacer rod 152 and to which the displacer sleeve 157 is threaded at its base, a support ring 162, and an insulator 164.

The displacer support plate 138, support rod 152, displacer sleeve 157, and rod guide 160 are made of type 6061-T651 aluminum. The displacer tube 156, shell cap 158, and support ring 162 are all formed of phenolic grade XXX. The displacer tube 156 is adhered to the displacer sleeve 157 at its base, and the displacer sleeve 157 is adhered to an annular support flange 166 of rod guide 160 by an adhesive sold by Hysol Aerospace Products, Dexter Adhesives & Structural Materials Div. of Pittsburg, CA, under the designation 9434. The cap 158 and ring 162 are adhered to the displacer tube 156 by the same adhesive. Eight circumferentially spaced ¼" openings 167, which intersect the outer circumference of flange 166, are provided in support flange 166.

The displacer assembly 154 is surrounded by a cold end heat exchanger 168 formed of phenolic grade XXX which is threaded to a type 6061-T6 aluminum cylindrical stuffer 169. The cold end heat exchanger 168 at its end surrounded by the cold end cup 96 contains 30 passages 198 on its outer surface 0.375" wide × 0.045" deep through which the helium gas passes into a gas expansion space 170, as best seen in FIG. 10. Since the gas in space 170 is at a temperature on the order of −173° C., the displacer assembly 154 is made of low thermal conductivity material, such as phenolic grade XXX, to minimize thermal conduction losses. Likewise, the insulator 164 provided below the end cap 158 is made of a material suitable for a temperature differential between the cold end and warm end of the displacer on the order of 215° K. A suitable insulating material is Solimide type TA-301 sold by IMI-Tech Corp. of Elk Grove Village, Ill. A Reemay 2295 filter 172 is placed between the insulator 164 and support ring 162 to prevent any particles of insulation shedding off the insulator 164 from entering the working gas where they could interfere with clearance seals.

The end of the stuffer 169 opposite the cold end heat exchanger 168 receives the three bolts 144 securing the displacer support plate 138 in place.

The end cap 158 may be provided with a threaded recess 174 to permit insertion and removal of the displacer assembly 154 in place on the displacer support rod 152.

A gas spring cap 176 formed of type 6061 T6 aluminum is threaded to the top of the displacer rod guide 160 forming a generally closed space 178 therein extending down through the center of the displacer support rod 152, which is filled with helium at an average pressure between the maximum and minimum pressure of the working gas in the heat pump to form a gas spring for the displacer assembly 154. That is, the displacer assembly 154, including displacer tube 156, end cap 158, rod guide 160, and cap 176, reciprocate lineraly in the cold end heat exchanger 168 on the displacer support rod 152. Space 178 filled with helium functions as a gas spring in cooperation with the resonant movement of the displacer at the operating frequency of the compressor in accordance with the teachings of U.S. Pat. No.

4,183,214, which disclosure is incorporated herein by reference.

A clearance seal of 0.0015" maximum exists between the inner diameter of the displacer rod guide 160 and the outer diameter of the displacer support rod 152. A clearance seal of 0.0040" maximum exists between the outer diameter of displacer sleeve 157 and the inner diameter of the stuffer 169. In both cases, the inner diameter of the external part (rod guide 160 and stuffer 169) are hard anodized and finished to a 4 micron finish, and the outer diameter of the internal part (support rod 152 and sleeve 157) are coated with Xylan 1014 (sold by Whitford Corp. of West Chester, Pa.), one mil thick, to provide a hard-on-soft bearing pair in case of minor contact.

Further, the displacer assembly 154 is supon about its longitudinal axis to provide non-contact hydrodynamic gas bearings between support rod 152 and rod guide 160 in accordance with the teachings of U.S. Pat. No. 4,330,993 and 4,412,418, which disclosures are incorporated by reference. That is, when the piston in the compressor section 36 of the heat pump 20 is moving downwardly, the working gas, in this case helium, is caused to flow down through the regenerator 134, through the rejector tubes 120, radially inwardly in a space 180 above support plate 138 and downwardly through openings 150 in support plate 138. In doing so, the gas under pressure impacts on a series of circumferentially disposed turbine fins 182 (FIGS. 7 and 9) affixed to the base of the displacer rod guide 160. There are 36 fins in all 0.232" in length and separated by 0.068". As the gas passes therethrough, the impact of the gas on the fins 182 causes the displacer assembly 154 to spin on its longitudinal axis between the inner diameter of the rod guide 160 and the outer diameter of the displacer support rod 152 forming the non-contacting hydrodynamic gas bearing.

In the position of the displacer assembly 154 as shown in FIG. 7, the turbine fins 182 are elevated out of space 180 However, when the helium gas is flowing downwardly toward the compressor and radially inward in space 180, the displacer is in a lowered position whereby the helium gas impacts on the turbine fins 182. When the gas is flowing in the opposite direction, i.e., away from the compressor toward the cold end 32, as the compressor piston cycles, the turbine fins are in their raised position shown in FIG. 7 out of space 180 whereby spinning movement is maintained in one direction only. When the heat pump is turned off, the displacer 154 is at rest in a lowered position. An annular recess 184 is provided to accommodate the turbine fins, and an annular elastomeric bumper 186 surrounding hub 140 prevents metal-to-metal contact between the displacer rod guide 160 and hub 140.

Because gas clearance seals allow the leakage of small amounts of gas, the components could drift off center. To minimize this problem, four equally spaced small diameter ports 190 of 0.040" in diameter are provided in the wall of the displacer rod guide 160. A circumferential groove 188 0.039" wide× 0.059" deep intercepts four ⅛" diameter holes 192 in the wall of support rod 152 which are open to the helium gas in inner space 178. When ports 190 and groove 188 come into registry, they permit movement of small gas quantities to equalize the pressure between the gas spring space 178, the surrounding interior space 194, and across the clearance seal therebetween. Likewise, a 0.020" port 196 is provided in the rod guide 160 to permit gas flow between the interior space 194 and a compression space 216. These centering ports 188 and 190 and 196 serve to maintain the proper positioning of the fixed and rotating parts in accordance with the teachings of U.S. Pat. No. 4,404,802, which disclosure is incorporated herein by reference.

Heat Rejection System

Referring again to FIGS. 2 and 7, heat is rejected from the rejector assembly 34 by the circulation of a refrigerant such as chlorodifluoromethane in the space 122 surrounding the rejector tubes 120. That is, the liquid refrigerant enters the space 122 through the pair of opposed lower stubs 132 (only one shown in FIGS. 2 and 7) and absorbs heat from the helium gas passing through the rejector tubes 120 by heat conduction through the tube walls. The absorption of heat from the gas causes the refrigerant to vaporize, and the vapor leaves the rejector through the four circumferentially spaced upper stubs 130 (only one shown in FIGS. 2 and 7). Stubs 130 connect with tubing 204 through which the vapor flows to the reflux condenser 22 mounted at the end wall 27 of the side car cabinet 16. The condenser is formed of four rows of vertical copper tubes 206 with sixteen tubes per row. The tubes 206 have a ⅜" outside diameter a wall thickness of 0.016" and communicate at their base with ⅝" outside diameter cross tubes. The tubes 206 are provided with flat copper fins 0.006" thick with 14 fins per inch to increase the heat transfer area. Vapor and liquid headers to which the ⅝" OD cross tubes connect at opposite ends of the rows are 1⅛" OD copper tubing with a 0.050" wall. The blower 24, which may include a ⅓ hp, three speed motor, operating at 230 volts 50/60 Hz, is located in the bottom of the side car cabinet 16 and draws air through the grill 26 through a standard air filter 207 and over the condenser tubes 206 to condense the refrigerant therein. The liquid refrigerant then flows by gravity from the condenser 22 through tubing 208 connected to stubs 132 into the bottom of the heat rejector space 122. The system preferably also includes a vibration arrestor for the fan 24 and a 400 psig relief valve.

Compressor

Referring to FIG. 8, the Stirling cycle heat pump is driven by the compressor assembly 36 which includes a linear drive motor 210, a spin motor 212, and a piston assembly 214 which is driven by the linear motor 210 in a reciprocating pattern to alternately expand and contract a working volume of helium in a compression space 216 above the piston assembly 214 and which is spun on its longitudinal axis by the spin motor 212 to cause hydrodynamic support of the piston assembly 214. The volume 216 communicates through openings 150 with space 180.

The linear motor 210, spin motor 212, and piston assembly 214 are contained in a pressure vessel for containing the helium under pressure on the order of 330 psig average pressure. The pressure vessel includes annular main support plate 97, an annular bottom plate 218, and a seamless cylindrical side wall 220 extending therebetween, all formed of carbon steel and welded together. The bottom plate 218 is in turn mounted to a lower support plate 222 by means of bolts 224 passing upwardly through the lower support plate 222 and threaded into bottom plate 218. Annular upper 226 and lower 228 flanges are welded respectively to the bottom plate 218 and the lower support plate 222. Once the unit is assembled and successfully tested, the flanges 226, 228 are welded about their circumference at 230 to seal the unit to provide in effect a pressure vessel for containing the helium working gas.

The linear drive motor 210 includes outer laminations 232 and inner laminations 234. The outer laminations 232 are supported between an upper 236 and lower 238 lamination support assembly which includes upper and lower lamination retaining rings 240. The inner motor laminations 234 are likewise supported by upper 242 and lower 244 inner lamination support assemblies. The lamination supports 236, 238, 240, 242, 244 are formed of a phenolic Ryertex grade X.

The upper outer lamination support assembly 236 is bolted to a flange on the piston cylinder 246 through an intermediate aluminum ring 248 which is epoxied to the phenolic support using Hysol 9434. The inner assembly 242, 244 is bolted to the bottom edge of the piston cylinder 246. Bolts 250 pass upwardly through the outer support assemblies 238, 236 and are threaded into main plate 97.

The linear motor coil 252 consists of 251 turns of #9 AWG round copper wire. The linear motor outer laminations 232 consist of 2650 laminations per unit of AISI M-15 silicon steel, 30-gauge 0.014" thick with C-3 finish. The inner laminations 234 are of like material and comprise 935 laminations per unit.

The spin motor 212 is supported by a spin motor support plate 252 formed of 6061-T651 aluminum which is secured by means of bolts to the phenolic lower outer lamination support 238 with an aluminum ring insert 258 interposed therebetween. The spin motor includes inner spin motor laminations 260 supported by an inner spin motor end frame 262, outer spin motor laminations 264 supported by an outer spin motor end frame 266. The end frame 262, 266 are formed of 6061-T651 aluminum. The inner 260 and outer 264 spin motor laminations are formed of 147 laminations of AISI M-15 silicon steel, 26-gauge 0.018" thick with a C-3 finish.

The inner spin motor laminations are wound with two sets of windings at 90° of one another forming a 2-phase induction motor known as a drag-cup rotor motor. The windings comprise 94 turns for each phase of #19 AWG copper wire.

The piston assembly 214 includes the fixed piston cylinder 246, a piston sleeve 270 reciprocal in the piston cylinder 246, a piston plug 272, which is screwed into the I.D. of top end of the piston sleeve 270 and welded in place, an annular piston flange 274 which is screwed onto O.D. of the bottom end of the piston sleeve 270 and welded in place, and a magnet paddle assembly 276 including upper and lower annular phenolic (Ryertex grade "XXX") support members with a magnetic ring 280 therebetween bolted to the outboard side of the piston flange 274. The magnet paddle assembly 276 is located between the inner 234 and outer 232 laminations of the linear drive motor 210.

The magnetic ring is made up of 13 equal sections of iron boron neodymium magnets having an energy product equalling 26,000,000 megagauss oersted with an HCI greater than 8,000 oersteds and BR greater than or equal to 9,500 gauss. Each segment has an ID of 2.759", an OD of 3.023", a width of 1.437", and spans an arc of 27°30", The individual magnets are glued along their vertical mating edges by Hysol 9434. Three layers of Kevlar (DuPont) cloth (28×24 weave, 1.3 oz/sq. yd) 3.5 mils thick are laid up on the exterior of the paddle using a Hysol epoxy 9436. The upper and lower phenolic annuli are glued respectively to the upper and lower ends of the magnetic ring 280. The phenolic is a grade XXX Ryertex. The magnetization direction is radially outward.

A cylindrical rotor 282 is fixed to the piston 270. The rotor 282 is caused to spin on its longitudinal axis by the spin motor 212 in turn causing spinning of the piston 270 in the sleeve 246 to form hydrodynamic of gas bearings therebetween. The rotor 282 is formed of 6061-T6 aluminum, has a 0.040" wall thickness, and has 12 0.031" wide by 3.976" long vertical slits equally spaced circumferentially and extending through the rotor tube wall. The upper end of the rotor 282 is welded to a rotor tube adaptor 281 also formed of 6061-T6 aluminum which in turn is fixed to an annular sleeve 283 in turn fixed to the piston sleeve 246 by four upper and two lower ⅛" diameter pins, the six pins being spaced 60° about the sleeve 283 circumference.

The linear motor 210 causes vertical linear reciprocation of the magnetic panel assembly 276 which in turn causes vertical linear reciprocation of the piston 270 within the piston cylinder 246 in a nearly sinusoidal pattern at a frequency of 44 Hz for optimum thermodynamic performance. At the same time, the spin motor 212 causes spinning of the rotor 282 which causes spinning of the piston 270 within the piston cylinder 246. The piston cylinder 246 and piston sleeve 270 are made of type 6061-T651 aluminum, hard anodized, with the facing surfaces honded to a 4 micron finish. The outer surface of the sleeve 270 is coated with Xylan 1014 minimum 1 mil thick. The diametral clearance between the piston sleeve 270 and piston cylinder 246 is 0.025" maximum. As stated, spinning of the piston 270 creates a hydrodynamic gas bearing with the helium in the pressure vessel to lubricate the piston as it reciprocates in the piston cylinder.

In general, all components should have minimal outgassing or coatings which would foul heat exchange surfaces or build up on clearance seals.

The piston sleeve 270 has eight 0.059" openings 284 which intersect a 0.061" wide ×0.059" deep groove about the outer perimeter of the sleeve 270. This groove aligns at the center of the piston stroke with eight like openings 286 in the piston cylinder 246 to provide when aligned pressure equalization across the gas bearing to maintain centering of the piston sleeve 270 in the cylinder 246 in the same manner that the displacer gas bearings are equalized. The pressure vessel is filled with helium under an average pressure of 330 psig, and openings provide communication of helium gas throughout the interior of the pressure vessel.

In addition, a 0.020" centering port 287 (FIG. 7) in displacer support plate 138 communicates between space 180 and the volume in the compressor 36 outside the cylinder 246 so that that volume has the same average pressure as the space 180.

Referring back to FIG. 2, the compressor assembly 36 has a heat pump support plate 290 mounted to it. Springs 292 and plate 288 form a tuned vibration absorber. The spring constant of springs 292 and the mass of plate 288 are tuned to the driving frequency of the vibration force while the mass and driving force of the heat pump are used to size spring and absorber mass with acceptable amplitude in accordance with well-known formulas such as that appearing at pages 136–138 of Thomson, William T., "Theory of Vibration with Applications," 3d Ed., Prentice Hall, 1988; and Mark, "Standard Handbook for Mechanical Engineers," 8th Ed., McGraw/Hill, 1978, p. 5-72.

The vibration absorber is in turn mounted to the base of the cabinet by adjustable mounting screw 294 adjustable from outside of the cabinet 11 (FIG. 2).

Referring back to FIG. 7, set screws 148 prevent further compression of gasket 146 by the force of piston cylinder 246 which could otherwise move displacer support plate 138 and cold end heat exchanger 168 upwardly which is unacceptable.

OPERATION OF HEAT PUMP

The operation of the Stirling cycle is well known and is described herein in terms of the particular construction of the free piston, closed cycle Stirling heat pump 20 described above. At a point in the Stirling cycle, the piston 270 in the compressor assembly 36 is driven by the linear motor 210 upwardly to compress the helium gas in the working space 216 above the piston plug 272. This compressing movement of the compressor piston 270 causes the pressure in the working volume of helium to rise from an average pressure of about 330 psig to a maximum pressure on the order of 375 psig which warms the working volume of gas. The helium gas in space 180 being in communication with the volume 216 is likewise compressed. At a point in the cycle, the increasing pressure creates a sufficient pressure on the displacer piston 154 to cause it to move rapidly downward. With this movement of the displacer 154, high pressure helium at about ambient temperature is forced through the regenerator 134 into the cold space 170 above the displacer 154 and inside the cold end cup 96. As the helium passes upwardly through the regenerator 134 the regenerator absorbs heat from the flowing pressurized gas and thereby reduces the temperature of the gas.

With the sinusoidal drive from the linear motor at 44 Hz, the compressor piston 270 then begins to move downwardly expanding the working volume in the space 216 above the piston head. With this expansion, the pressure drops to about 285 psig, and the helium in the cold space 170 is cooled even further. It is this cooling in the cold space which provides the refrigeration for maintaining a temperature gradient of over 200° Kelvin over the length of the regenerator 134 and an input of about 200 watts of heat from the argon to the expansion space helium at the low temperatures of −160° C. or less.

At some point in the expanding movement of the piston 270, the pressure in the working volume 216 drops sufficiently so that the momentum of the displacer 154 is overcome by the retarding force of the internal gas spring in which helium gas in space 178 is stabilized at an average pressure of about 330 psig. The displacer 154 is then driven upwardly thus driving the cool gas in the cold space 170 back through the regenerator 134 and the cycle is repeated. The displacer 154 thus cycles at a resonant frequency with the piston although out of phase therewith.

As described above, the flow of the pressurized helium through the turbine vanes 182 causes the spinning of the displacer rod guide 160 to maintain its hydrodynamic support throughout the cycle. Likewise the spin motor assembly 212 causes spinning of the piston assembly 214 to maintain its hydrodynamic support throughout the cycle.

A temperature differential of about 13° C. is maintained between the desired storage chamber 12 temperature and the helium in the cold end 32 of the heat pump and about 10° C. between the storage chamber temperature and the temperature of the liquid argon. Thus, for a −160° C. storage chamber temperature, the liquid argon is at −170° C. and the helium is at −173° C. At temperatures of −160° C. or less about 200 watts of heat are input into the helium in condensing the argon gas in the pressure vessel surrounding the cold end cup. The heat input to the helium plus the input work to drive the heat pump compression and expansion cycles and frictional losses are removed from the heat pump by circulating the refrigerant in the interior space 122 surrounding the helium flowing through the stainless steel tubes 120. The refrigerant is vaporized by the heat absorbed from the helium thereby removing the heat from the system. The refrigerant vapor flows through tube 204 to the reflux condenser 22 of the vertical tube gravity flow type. A forward curved direct drive blower 24 pulls air in through the grill 26 in the end wall 27, through an air filter 207, and over the condenser tubes 206 to condense the refrigerant which then flows by gravity through a return tube 208 and into the bottom of the rejector subassembly 34 where it again is vaporized thereby removing heat from the gas.

An expansion tank 296 can be located in the side car 16 for containing the argon gas refrigerant at room temperature when the unit is not in use. This argon system operates at a saturation pressure of about 50 psig, and the tank 296 contains the super-heated argon at a pressure of about 200 psig at room temperature.

If desired tubing may be provided to the bottom of the freezer chamber 12 and a fitting provided on the back wall of the cabinet 11 to connect to a back up source of liquid nitrogen external of the freezer 10 in the event of an unintended shutdown of the freezer to maintain low storage temperatures in the chamber 12 until the freezer is restarted.

Still further, instrumentation may be provided to monitor the condition of the heat pump including, for example, loss of helium, loss of displacer or piston spin, over-stroking of the displacer or piston, temperature setpoint, and elevated warm end temperature. For example, optical position sensors are desirably used to monitor piston and displacer position and spin.

Although the present invention is directed principally to a laboratory freezer appliance capable of providing storage temperatures of −160° C. and lower, it will be recognized that it could be operated at higher temperatures while still achieving the benefits of the invention.

Thus having described the invention, what is claimed is:

1. A laboratory freezer appliance comprising:

an insulated freezer chamber;

heat transfer tubes in heat transfer communication with said chamber, said tubes being sloped from one end to another permitting the flow by gravity of a heat transfer fluid as a liquid downwardly along said freezer chamber and the counterflow of said fluid as a vapor;

a Stirling cycle heat pump of the type having a housing containing a linearly reciprocating piston and a displacer, said heat pump having a warm zone and a cold zone;

a condensating chamber in heat transfer communication with said cold zone for condensing said heat transfer fluid as a vapor to a liquid including first means for receiving said vapor and second means for returning said liquid; and heat transfer fluid distribution means for receiving said condensed heat transfer fluid and distributing it to said heat transfer tubes and for receiving back from said heat transfer tubes said vapor and distributing it to said condensing chamber in a closed cycle of alternate condensation and vaporization of said heat transfer fluid and consequent cooling of said freezer chamber.

2. The laboratory freezer appliance of claim 1 wherein said heat transfer fluid distribution means comprises a closed chamber including a liquid reservoir and a gas head space thereabove for receiving said liquid from said condensing chamber and distributing it to a plurality of tubes communicating at one end with the reservoir and at the other with inlet ends to said heat transfer tubes and for receiving back from said heat transfer tubes said vapor and distributing it from said gas head space to said condensing chamber.

3. A laboratory freezer appliance comprising:

an insulated freezer chamber having a front wall and a back wall and a bottom and defining therein a storage volume spaced from said front and back walls and from said bottom wall;

heat transfer tubes extending within said freezer chamber and along its length and being in heat transfer communication with the air in said chamber, said tubes being sloped from one end to another permitting the flow by gravity of a heat transfer fluid as a liquid downwardly along said freezer chamber and the counterflow of said fluid as a vapor, said heat transfer tubes being located towards the top of said freezer chamber and absorbing heat from the air in said freezer chamber inducing the flow of air at low temperature downwardly along the front and back wall of the chamber and across the bottom wall;

a closed cycle, hermetically sealed Stirling cycle heat pump of the type having a housing containing a linearly reciprocating piston and a displacer, said heat pump having a warm zone and a cold zone;

a condensing chamber in heat transfer communication with said cold zone for condensing said heat transfer fluid as a vapor to a liquid including first means for receiving said vapor and second means for returning said liquid;

means for extracting heat from said working gas; and heat transfer fluid distribution means for receiving said condensed heat transfer fluid as a liquid and distributing it to said heat transfer tubes and for receiving back from said heat transfer tubes said vapor and distributing it to said condensing chamber in a closed cycle of alternate condensation and vaporization of said heat transfer fluid and consequent cooling of the air in said freezer chamber.

4. The laboratory freezer appliance of claim 3 wherein said storage volume comprises two smaller volumes spaced from one another along a generally central plane and wherein the flow of air at low temperature moves from said bottom wall upwardly between said smaller volumes along said central plane.

5. A laboratory freezer appliance comprising an insulated freezer chamber;

heat transfer tubes in heat transfer communication with said chamber, said tubes being sloped from one end to another permitting the flow by gravity of a heat transfer fluid as a liquid downwardly along said freezer chamber and the counterflow of said fluid as a vapor;

a closed cycle, hermetically sealed free piston Stirling cycle heat pump of the type having a housing containing a linearly reciprocating piston and a displacer driven in reciprocation by the alternate expansion and compression of a working gas within a compression space at one end of said piston, said heat pump having a warm zone and a cold zone;

a condensing chamber surrounding said cold zone defining a space for receiving said heat transfer fluid as a vapor, said space being in heat transfer communication with said cold zone for absorbing heat from said heat transfer fluid as a vapor and condensing it to a liquid, said chamber including first means for introducing said vapor into said space and second means for removing said condensed liquid;

heat transfer fluid distribution means for receiving said condensed heat transfer fluid as a liquid and distributing it to said heat transfer tubes and for receiving back from said heat transfer tubes said vapor and distributing it to said condensing chamber in a closed cycle of alternate condensation and vaporization of said heat transfer fluid and consequent cooling of said freezer chamber.

6. A laboratory freezer appliance comprising:

an insulated freezer chamber;

heat transfer tubes in heat transfer communication with said chamber, said tubes being sloped from one end to another permitting the flow by gravity of a heat transfer fluid as a liquid downwardly along said freezer chamber and a counterflow of said fluid as a vapor;

a Stirling cycle heat pump of the type having a housing containing a linearly reciprocating piston and a displacer, said heat pump having a warm zone and a cold zone;

said cold zone being disposed at the end of said displacer and including a working gas expansion space located between said displacer and a metal cold end cup;

a condensing chamber defined by a cap surrounding said cold end cup and spaced therefrom, said condensing chamber being in heat flow communication with said working gas expansion space through the wall of said cold end cup;

means for introducing said heat transfer fluid as a vapor to said condensing chamber and means of removing said heat transfer fluid as a liquid from said condensing chamber without physical pumping means;

heat transfer fluid distribution means for distributing said condensed heat transfer fluid to said heat transfer tubes and for distributing said heat transfer fluid as a vapor to said condensing chamber without physical pumping means in a closed cycle of alternate condensation and vaporization of said heat transfer fluid and consequent cooling of said freezer chamber.

7. The laboratory freezer appliance of claim 6 wherein said cold zone further includes a plurality of metal fins in heat transfer communication with said cold end cup and extending into said condensing chamber for increasing the heat transfer between said vapor in said condensing chamber and said working gas expansion space.

8. The laboratory freezer appliance of claim 6 further comprising an insulator disposed between said displacer and said cold end cup, said insulator having a plurality of longitudinal slots in its outer circumferential surface through which said working gas passes between said compression space and said expansion space.

9. The laboratory freezer appliance of claim 6 further comprising means for extracting heat from said working gas, said means comprising a chamber through which a refrigerant fluid circulates, a plurality of tubes located in said chamber, the interior of said tubes being in heat transfer communication with the refrigerant circulating in said chamber through the walls thereof, said working gas flowing through said tubes, and a condenser external of said heat pump for removing heat from said refrigerant.

10. A laboratory freezer appliance comprising an insulated freezer chamber;

heat transfer tubes in heat transfer communication with said chamber, said tubes being sloped from one end to another permitting the flow by gravity of a heat transfer fluid as a liquid downwardly along said freezer chamber and the counterflow of said fluid as a vapor without mechanical pump means;

a Stirling cycle heat pump of the type having a housing containing a linearly reciprocating piston and a displacer, said heat pump having a warm zone and a cold zone;

a condensing chamber in heat transfer communication with said cold zone for condensing said heat transfer fluid as a vapor to a liquid including first means for receiving said vapor and second means for returning said liquid; and heat transfer fluid distribution means for receiving said liquid from said condensing chamber and distributing it to said heat transfer tubes and for receiving back from said heat transfer tubes said vapor and distributing it to said condensing chamber without the use of mechanical pump means in a closed cycle of alternate condensation and vaporization of said heat transfer fluid and consequent cooling of said freezer chamber, said heat transfer fluid being at an elevated pressure.

11. The laboratory freezer appliance of claim 10 wherein said elevated pressure is about 5 bar.

12. A laboratory freezer appliance comprising:

an insulated freezer chamber;

heat transfer tubes in heat transfer communication with said chamber;

a free piston Stirling cycle heat pump having a vertical linearly reciprocating piston and a displacer vertically axially aligned with said piston and driven in reciprocation with said piston by the alternate expansion and compression of a working gas between a maximum and a minimum pressure;

motor means for driving said piston in vertical linear reciprocation and for rotating said piston about its vertical axis to hydrodynamically support said piston on gas bearings formed by said working gas;

said displacer comprising a cylindrical shell and end cap, said displacer being supported on a displacer rod guide, means for rotating said displacer on said displacer rod guide on its vertical axis to hydrodynamically support said displacer on gas bearings formed by said working fluid, and a gas spring internal of said displacer having an average pressure between said maximum and said minimum pressure;

a cold end cup surrounding said displacer at its end remote from said piston and defining in combination with said displacer end cap a working gas expansion space;

a cap surrounding said cold end cup and spaced therefrom defining a condensing chamber therebetween for receiving a heat transfer fluid as a vapor under pressure, said condensing chamber being in heat transfer communication with said expansion space whereby said working gas in said expansion space extracts heat from said heat transfer fluid vapor and condenses it to a liquid;

means for extracting heat from said working gas; and heat transfer fluid distribution means for receiving said condensed heat transfer fluid and distributing it to said heat transfer tubes and for distributing said heat transfer fluid as a vapor to said condensing chamber in a closed cycle of alternate condensation and vaporization of said heat transfer fluid and consequent cooling of said freezer chamber.

13. The freezer appliance of claim 12 wherein said means for rotating said displacer comprises a plurality of circumferentially spaced vanes impacted by said working gas.

14. The laboratory freezer appliance of claim 12 wherein said means for extracting heat from said working gas comprises a heat rejector assembly comprising a chamber through which a refrigerant flows, a plurality of metal tubes passing through said chamber and through which said working gas flows, said metal tubes being in heat transfer communication with said refrigerant through the walls thereof whereby heat is extracted from said working gas by said refrigerant, and a condenser external of said heat pump for removing said extracted heat from said refrigerant.

15. The laboratory freezer appliance of claim 12 wherein said working gas in said expansion space extracts about 200 watts of heat from said vapor.

16. A laboratory freezer appliance comprising an insulated freezer chamber;

heat transfer tubes in heat transfer communication with said chamber, said tubes being sloped from one end to another permitting the flow by gravity of liquid argon downwardly along said freezer chamber and the counterflow of argon vapor;

a Stirling cycle heat pump of the type having a housing containing a linearly reciprocating piston and a displacer, said heat pump having a warm zone and a cold zone;

a condensing chamber in heat transfer communication with said cold zone for condensing said argon vapor to a liquid including first means for receiving said vapor and second means for returning said liquid; and heat transfer fluid distribution means for receiving said argon liquid and distributing it to said heat transfer tubes and for receiving back from said heat transfer tubes said argon vapor and distributing it to said condensing chamber in a closed cycle of alternate condensation and vaporization of said argon and consequent cooling of said freezer chamber, said argon being under pressure and flowing as a liquid and a vapor between said heat transfer tubes and said condensing chamber without the aid of mechanical pump means.

17. The laboratory freezer appliance of claim 16 wherein said argon pressure is on the order of 5 bar.

18. The laboratory freezer appliance of claim 16 wherein said helium cycles between a minimum pressure of about 285 psig and a maximum pressure of about 375 psig.

19. A laboratory freezer appliance comprising:

an insulated freezer chamber having a length and width defined by front and rear and bottom walls;

support racks in said freezer chamber defining a pair of storage volumes, said support racks being spaced from said front and back and bottom walls of said freezer chamber defining spaces therebetween;

heat transfer tubes in heat transfer communication with the air in said chamber, said tubes being sloped from one end to another permitting the flow by gravity of a heat transfer fluid as a liquid downwardly along said length of said freezer chamber and the counterflow of said heat transfer fluid as a vapor, said heat transfer tubes being located generally at the top of said freezer chamber and being operable to extract heat from the air in said freezer chamber thereby inducing the flow of ultralow temperature air downwardly along the front and rear walls across the bottom wall and upwardly between the storage spaces;

a free piston Stirling cycle heat pump of the type having a housing containing a linearly reciprocating vertical piston assembly and a vertical displacer assembly thereabove driven in reciprocation by the alternate expansion and compression of a working gas within said compression space above said piston between a minimum pressure and a maximum pressure, said heat pump comprising further a first linear motor for reciprocating said piston in a vertical direction and a second spin motor for spinning said piston assembly on its vertical axis;

a pressure vessel for containing said piston assembly in said working gas;

a displacer support plate supporting said displacer assembly and including a hub centrally thereof supporting a displacer rod guide and including through openings about said hub permitting flow of said working gas to and from said compression space;

said displacer assembly including a displacer cylinder and displacer end cap formed of a heat insulating material and a displacer sleeve surrounding said displacer rod guide;

a cold end heat exchanger surrounding said displacer assembly;

a cold end cup surrounding in turn said cold end heat exchanger and defining with said cold end heat exchanger remote from said piston and with said displacer end cap a working gas expansion space therebetween, said cold end heat exchanger including a plurality of vertically oriented slots in the outer circumference thereof permitting the flow of working gas into and out of said expansion space;

a cap surrounding said cold end cup and spaced therefrom defining therebetween a condensing chamber for receiving said heat transfer fluid as a vapor, said condensing chamber being in heat transfer communication through the wall of said cold end cup whereby said expansion chamber working gas extracts heat from said heat transfer fluid vapor in said condensing chamber condensing it to a liquid;

a rejector assembly located between said cold end cup and said displacer support plate comprising an annular chamber through which a refrigerant circulates and a plurality of tubes through which said working gas passes, the interior of said tubes being in heat transfer communication with said refrigerant through the tube walls whereby said refrigerant extracts heat from said working gas;

a reflux condenser external of said heat pump for removing heat from said refrigerant;

a gas spring internal of said displacer assembly comprising an enclosed space defined by a gas spring cap and the interior of said displacer rod guide, and containing the working gas at an average pressure between said maximum pressure and said minimum pressure of said working gas;

said spin motor causing hydrodynamic support of said compressor assembly on gas bearings formed by the working gas;

heat transfer distribution means for receiving said condensed heat transfer fluid as a liquid and distributing it to said heat transfer tubes and for receiving back from said heat transfer tubes said heat transfer fluid as a vapor and distributing it to said condensing chamber without the aid of mechanical pump means in a closed cycle of alternate condensation and vaporization of said heat transfer fluid and consequent cooling of said freezer chamber.

20. The laboratory freezer appliance of claim 19 wherein said displacer assembly includes turbine vanes at the base thereof impacted by said working gas causing spinning of said displacer assembly and hydrodynamic support of said displacer assembly on gas bearings between said displacer assembly and said displacer rod guide, said gas being the working gas.

21. The laboratory freezer appliance of claim 19 wherein the temperature differential between the freezer chamber and the heat transfer liquid is about 10° C. and the temperature differential between the heat transfer vapor and the working gas in the expansion space is about 3° C.

22. The laboratory freezer appliance of claim 21 wherein the freezer chamber is at a temperature of −160° C. or lower.

23. The laboratory freezer appliance of claim 21 wherein said heat transfer fluid is argon at a pressure of about 5 bar.

24. The laboratory freezer appliance of claim 19 wherein the working gas is helium which cycles between about 285 psig and about 375 psig.

25. The laboratory freezer appliance of claim 19 wherein said linear motor cycles said piston at a frequency of about 44 Hz

26. The laboratory freezer appliance of claim 19 wherein said heat transfer fluid is argon, said working gas is helium, the temperature differential between said freezer chamber and said argon liquid is about 10° C., the temperature differential between said argon in said condensing chamber and said helium in said expansion space is about 3° C., and said helium in said expansion space removes about 200 watts of heat from said argon vapor in said condensing chamber.

* * * * *

UNITED STATES PATENT AND TRADEMARK OFFICE

CERTIFICATE OF CORRECTION

PATENT NO. : 5,142,872

DATED : September 1, 1992

INVENTOR(S) : Russell C. Tipton

It is certified that error appears in the above-identified patent and that said Letters Patent is hereby corrected as shown below:

In column 7, line 61, "n" should be --in--.

In column 9, line 8, "100." should be --100,--.

In column 9, line 10, "10" should be --108--.

In column 11, line 16, "supon" should be --spun--.

In column 11, line 40, after "180", insert --.--.

In column 13, line 29, "252" should be --254--.

In column 14, line 29, "honded" should be --honed--.

Signed and Sealed this

Twenty-first Day of December, 1993

*Attest:*

Bruce Lehman

BRUCE LEHMAN

*Attesting Officer*

*Commissioner of Patents and Trademarks*